US005211771A

United States Patent [19]

Okiyama et al.

[11] Patent Number: 5,211,771

[45] Date of Patent: May 18, 1993

[54] SOFT MAGNETIC ALLOY MATERIAL

[75] Inventors: Takuji Okiyama; Ryoji Hirota; Takuji Hara; Yutaka Kawai; Toshihiko Takemoto, all of Shin-Nan'yo, Japan

[73] Assignee: Nisshin Steel Company, Ltd., Tokyo, Japan

[21] Appl. No.: 848,202

[22] Filed: Mar. 10, 1992

[30] Foreign Application Priority Data

Mar. 13, 1991 [JP] Japan ..... 3-072213

[51] Int. Cl.[5] ..... H01F 1/04

[52] U.S. Cl. ..... 148/310; 148/312; 148/315

[58] Field of Search ..... 148/310, 312, 315, 336, 148/409, 427, 428, 429, 442; 420/445, 446, 451, 452, 581, 582, 583

[56] References Cited

U.S. PATENT DOCUMENTS 3,837,844 9/1974 Makita et al. ..... 148/310
3,837,933 9/1974 Masumoto et al. ..... 148/312
3,871,927 3/1975 Masumoto et al. ..... 148/312

FOREIGN PATENT DOCUMENTS 60-46341 3/1985 Japan ..... 148/312

*Primary Examiner*—John P. Sheehan
*Attorney, Agent, or Firm*—Webb, Burden, Ziesenheim & Webb

[57] ABSTRACT

Fe-Ni, Fe-Ni-Cr or Fe-Ni-Cr-Mo magnetic alloy material, the surface roughness of which is adjusted to Rz≧0.5 or Ra≧0.06, is disclosed. Parts made of this material has resistance to mutual adhesion or sticking when they are subjected to anealing treatment.

16 Claims, 2 Drawing Sheets

SOFT MAGNETIC ALLOY MATERIAL

FIELD OF THE INVENTION

The present invention relates to an improvement in plate materials of Fe-Ni, Fe-Ni-Mo and Fe-Ni-Cr soft magnetic alloy useful for magnetic shielding parts, magnetic cores, etc. in various applications. The improvement is intended to prevent sticking or adhesion between parts of the material when the parts are subjected to magnetic annealing after they have been shaped.

BACKGROUND OF THE INVENTION

As materials for magnetic shielding parts and magnetic core elements represented by cores of clocks, small size transformers, etc., alloys of JIS-PB, JIS-PC alloys and Fe-Ni(Mo, Cu) alloys and Fe-Ni-Cr alloys are widely used.

Usually these magnetic alloy materials are subjected to magnetic annealing after they have been shaped for imparting good magnetic characteristics. Magnetic annealing is effected in a hydrogen atmosphere at a high temperature of 900°-1200° C. for a prolonged time of 0.5-2 hours. In magnetic annealing, there is a problem that parts stick to each other during annealing when a large number of parts are treated at one time. Therefore, the parts are embedded in a large amount of alumina powder to prevent adhesion in the conventional technique.

Nowadays a larger number of parts are treated at one time and use of a large amount of alumina powder causes problems such as the need for separation by screening and rinsing of the treated parts, which invites increase in the production cost. Screening and rinsing operations cause strain in the treated parts, which degrades magnetic properties of the parts. Therefore, there is a strong demand for improvement in the method of magnetic annealing when reduction of production cost, down-sizing of parts and improvement in performance of products are imperative in the electronic magnetic industry. The present invention aims at eliminating the need for the alumina powder when the Fe-Ni, Fe-Ni-Mo, Fe-Ni-Cr alloy parts are subjected to magnetic annealing after shaped.

SUMMARY OF THE INVENTION

Adhesion of parts of Fe-Ni, Fe-Ni-Mo or Fe-Ni-Cr alloy materials during magnetic annealing can be prevented by alloying one or more of Al and Ti, which have strong affinity to oxygen, in the above alloys in an amount of 0.04-1.2%, preferably 0.04-0.5% and adjusting the surface roughness of the alloy coil to $Rz \geqq 0.5$ μm or $Ra \geqq 0.06$ μm. Rz refers to ten point mean roughness and Ra refers to center-line mean roughness, as standarized in Japanese Industrial Standard JIS B 0601 for expressing the surface roughness of industrial products.

Surface roughness can be adjusted by subjecting the cold-rolled plate to finish rolling with rollers having desired surface roughness.

SPECIFIC DISCLOSURE OF THE INVENTION

The invention will now be described specifically with reference to the attached drawings.

In order to prevent adhesion of parts of Fe-Ni, Fe-Ni-Mo, Fe-Ni-Cr soft magnetic alloy materials during magnetic annealing, we carried out extensive experiments to learn concentration to the surface region of various alloying elements after annealing and influence of surface roughness of the resulting plates.

The defined contents of the principal ingredients Ni. Cr, Mo and Cu are required to attain magnetic characteristics of the JIS-PB, PC, PD and PE levels. In the low Ni alloys of JIS-PB, PD and PE classes, the Ni content is defined as 35-60%. In the high Ni alloys of JIS-PC class, the Ni content is defined as 60-85%, the Mo content is defined as $\leqq 6\%$ and the Cu content is defined as $\leqq 4\%$. In order to attain magnetic permeability of the JIS-PC level, Cr should be contained in an amount of 5-14% in the lower Ni alloy containing 35-40% and in an amount of 0.5-5% in the lower Ni alloys containing 40-52% Ni.

The reasons for defining the Al content and the surface roughness are as follows.

Figure 1:
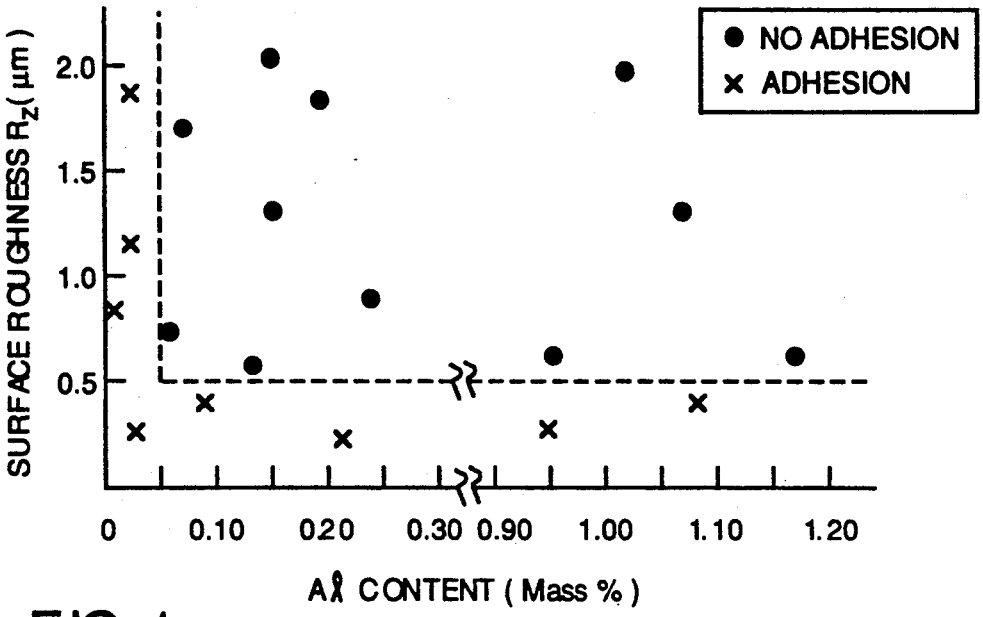
FIG. 1 is a graph showing the effect of Al and surface roughness Rz on adhesion during magnetic annealing.
Figure 2:
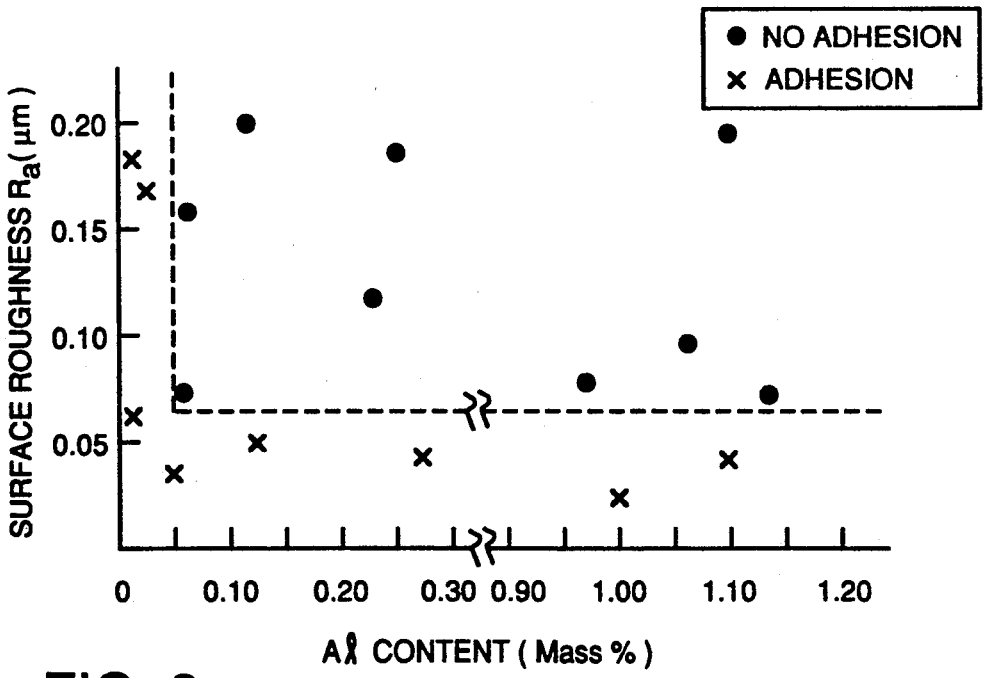
FIG. 2 is a graph showing the effect of Al and surface roughness Ra on adhesion during magnetic annealing.

FIGS. 1 and 2 show the results of the magnetic annealing tests carried out at 1100° C. for 1 hour in a hydrogen atmosphere for test pieces having a thickness of 0.5 mm of Fe-80Ni-5Mo alloys and Fe-46Ni alloys when Al content and surface roughness are varied. From these graphs, it is apparent that adhesion during the magnetic annealing can be prevented by adding Al of 0.04% or more and adjusting the surface roughness to $Rz \leqq 0.5$ μm or $Ra \leqq 0.06$ μm.

Figure 3:
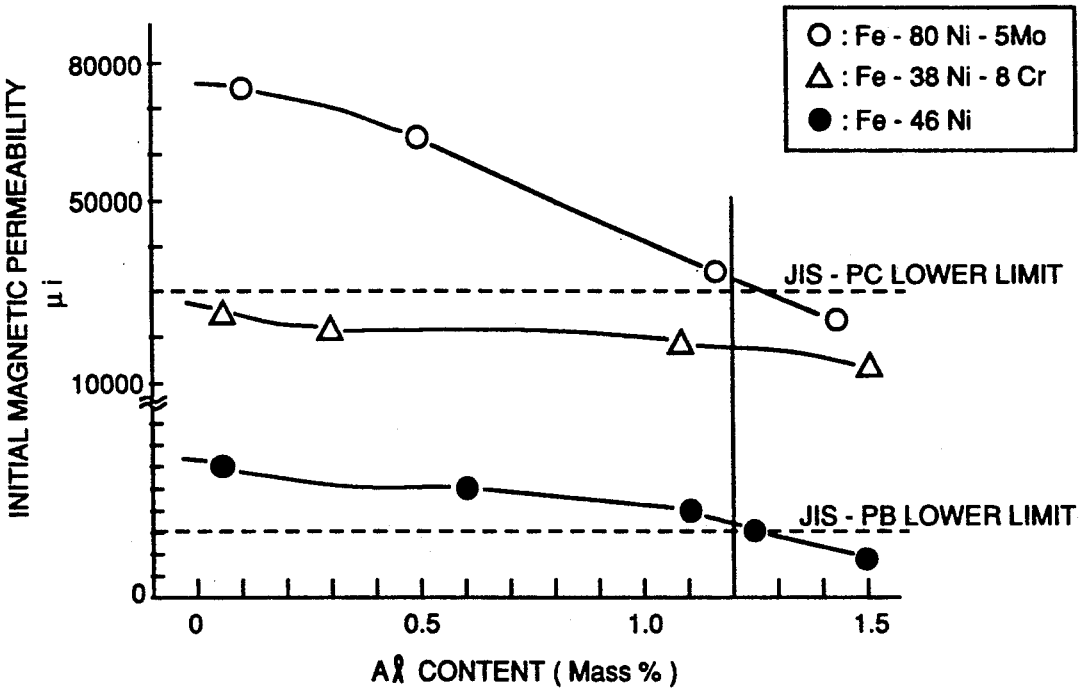
FIG. 3 is a graph showing the effect of Al on initial magnetic permeability.

On the other hand, FIG. 3 shows that an excess amount of Al degrades initial magnetic permeability. Accordingly, the upper limit in the Al content is defined as 1.2%.

Ti showed the effect of preventing adhesion of the same level as Al. Therefore, the Ti is contained in an amount up to 1.2%. Si and Mn, which have strong affinity to oxygen, however, did not exhibit so good effect for prevention of adhesion. Zr caused remarkable degradation of initial magnetic permeability even with the addition of 0.02% level.

The alloy materials of the present invention can contain boron (B). Fe-Ni alloys is in the state of single austenite phase at high temperatures. Therefore, they have high resistance to hot working and inevitably their hot rolling yield is low. B is effective for improvement of hot workability of the alloys. B exhibits this effect with the addition of at least 0.001%. However, if it is contained in an amount in excess of 0.02%, the hot workability is degraded by formation of borides. Thus the B content is defined as 0.001-0.02%.

As described above, the alloy materials of the present invention are free from adhesion during annealing because of addition of Al or Ti and adjustment of the surface roughness. It is surmised that adhesion of shaped metal parts by mutual diffusion of metal is prevented by increased contact with hydrogen flow and concentration of Al or Ti in the surface layer (oxide is formed by reaction with a slight amount of oxygen in the hydrogen flow).

EXAMPLE 1

Each 400 kg of the Fe-Ni alloys, the compositions of which are indicated in Table, 1 was prepared by vacuum melting and made into a 0.6 mm thick coil by ordinary hot rolling and cold rolling and the surface roughness was adjusted. From this coil, 5000 pieces of cores for clocks were prepared by punching and shaping and the obtained core pieces were subjected to annealing in a hydrogen atmosphere at 1100 ° C. for 2 hours in a continuous annealing furnace. Occurrence of adhesion is indicated with the comparison with a product of the conventional annealing in Table 2.

According to these tables, the percentage of occurrence of adhesion is 0.1–0.3% for 5000 pieces of parts with respect to both the parts containing the defined amounts of Al or Ti and having the defined surface roughness and the parts annealed by the conventional annealing method using alumina powder. Therefore, adhesion during annealing can be prevented in accordance with the present invention without using alumina powder.

The percentage of occurrence of adhesion is defined as follows:

Occurrence of adhesion (%)=(number of pieces suffering adhesion/number of total pieces)×100

EXAMPLE 2

Each 400 kg of the Fe-Ni-Mo-(Cu) alloys, the compositions of which are indicated in Table 3, was prepared by vacuum melting and made into a 0.5 mm thick alloy coil by ordinary hot rolling and cold rolling and the surface roughness was adjusted. From this coil, 5000 pieces of magnetic head casings were prepared by punching and shaping and the obtained pieces were subjected to annealing in a hydrogen atmosphere at 1100 ° C. for 1 hour in a continuous annealing furnace.

Occurrence of adhesion is indicated with the comparison with a product of the conventional annealing using alumina powder in Table 4.

From these tables, it is apparent that adhesion during annealing can be prevented in accordance with the present invention without using alumina powder at the same level as the conventional method using alumina powder.

EXAMPLE 3

Each 400 kg of the Fe-Ni-Cr alloys, the compositions of which are indicated in Table 5, was prepared by vacuum melting and made into a 0.3 mm thick coil by ordinary hot rolling and cold rolling and the surface roughness was adjusted. From this coil, 5000 pieces of a magnetic head cover were prepared by punching and shaping and the obtained pieces were subjected to annealing in a hydrogen atmosphere at 1050° C. for 1 hour in a continuous annealing furnace.

Occurrence of adhesion is indicated with the comparison with the product of the conventional annealing in Table 6. From these tables, it is apparent that adhesion during annealing can be reduced in accordance with the present invention without using alumina powder to the same level as the conventional method using alumina powder.

EXAMPLE 4

Each 400 kg of the Fe-Ni-Cr alloys, the compositions of which are indicated in Table 7, was prepared by vacuum melting and made into a 0.6 mm thick alloy coil by ordinary hot rolling and cold rolling and the surface roughness was adjusted. From this coil, 5000 pieces of a stater for clock were prepared and the obtained pieces were subjected to annealing in a hydrogen atmosphere at 1100° C. for 2 hours in a continuous annealing furnace.

Occurrence of adhesion is indicated with the comparison with a product of the conventional annealing in Table 8. From these tables, it is apparent that adhesion during annealing can be reduced in accordance with the present invention without using alumina powder.

Example 5

Each 400 kg of the Fe-Ni alloy, the composition of which is indicated in Table 9, was prepared by vacuum melting and made into a 0.5 mm thick coil by ordinary hot rolling and cold rolling and the surface roughness was adjusted. From this coil, 5000 pieces of E-shape magnetic core for transformer were prepared and the obtained pieces were subjected to annealing in a hydrogen atmosphere at 1100° C. for 2 hours in a continuous annealing furnace. Depth of edge cracks and yield in the hot rolling and occurrence of adhesion in magnetic annealing are shown in Table 10.

From Table 10, it is apparent that addition of B increases the hot rolling yield by 5-10% and adhesion in annealing can be prevented without using alumina powder in accordance with the present invention.

As has been described above, adhesion of shaped parts can be prevented without using alumina powder in accordance to the present invention. Handling before and after magnetic annealing of the parts to be treated can be simplified and thus cost for magnetic annealing can be remarkably reduced.

TABLE 1

| No. | Ni | C | Si | Mn | Al | Ti | Thickness (mm) | Surface Roughness (μm) |
|---|---|---|---|---|---|---|---|---|
| 1 | 35.8 | 0.01 | 0.18 | 0.42 | 0.051 | 0.001 | 0.6 | Rz = 0.1 Ra = 0.02 |
| 2* | 38.2 | 0.02 | 0.21 | 0.35 | 0.083 | 0.001 | 0.6 | Rz = 0.5 Ra = 0.12 |
| 3* | 39.5 | 0.02 | 0.13 | 0.38 | 0.351 | 0.030 | 0.6 | Rz = 0.4 Ra = 0.07 |
| 4 | 40.8 | 0.01 | 0.30 | 0.48 | 0.005 | 0.060 | 0.6 | Rz = 0.4 Ra = 0.05 |
| 5* | 45.5 | 0.01 | 0.15 | 0.36 | 0.005 | 0.518 | 0.6 | Rz = 1.3 Ra = 0.31 |
| 6* | 46.3 | 0.01 | 0.21 | 0.51 | 0.883 | 0.063 | 0.6 | Rz = 0.3 Ra = 0.06 |
| 7 | 50.6 | 0.02 | 0.25 | 0.46 | 0.151 | 0.005 | 0.6 | Rz = 0.2 Ra = 0.03 |
| 8* | 53.4 | 0.01 | 0.16 | 0.41 | 1.132 | 0.082 | 0.6 | Rz = 0.3 Ra = 0.07 |
| 9* | 56.5 | 0.01 | 0.23 | 0.50 | 0.003 | 0.095 | 0.6 | Rz = 2.4 Ra = 0.60 |

*Invention Plates

TABLE 2

| No. | Occurrence of Adhesion | Evaluation |
|---|---|---|
| 1 | 43.0 | X |

TABLE 2-continued

| No. | Occurrence of Adhesion | Evaluation |
|---|---|---|
| 2* | 0.22 | ○ |
| 3* | 0.20 | ○ |
| 4 | 39.2 | X |
| 5* | 0.16 | ○ |
| 6* | 0.10 | ○ |
| 7 | 25.1 | X |
| 8* | 0.10 | ○ |
| 9* | 0.18 | ○ |
| No. 1 with alumina powder | 0.24 | ○ |

*Invention plates

TABLE 6

| No. | Occurrence of Adhesion | Evaluation |
|---|---|---|
| 1* | 0.24 | ○ |
| 2 | 25.1 | X |
| 3 | 39.7 | X |
| 4* | 0.18 | ○ |
| 5 | 40.3 | X |
| 6* | 0.18 | ○ |
| 7* | 0.22 | ○ |
| No. 2 with alumina powder | 0.22 | ○ |

*Invention plates

TABLE 7

| No. | Ni | Cr | Si | Mn | Al | Ti | Thickness (mm) | Surface Roughness (μm) |
|---|---|---|---|---|---|---|---|---|
| 1 | 35.3 | 6.1 | 0.19 | 0.36 | 0.003 | 0.002 | 0.6 | Rz = 2.8 Ra = 0.67 |
| 2* | 36.1 | 5.8 | 0.15 | 0.09 | 0.076 | 0.021 | 0.6 | Rz = 2.4 Ra = 0.51 |
| 3 | 36.8 | 10.4 | 0.31 | 0.18 | 0.006 | 0.001 | 0.6 | Rz = 1.2 Ra = 0.33 |
| 4 | 37.2 | 8.3 | 0.22 | 0.26 | 0.058 | 0.034 | 0.6 | Rz = 0.1 Ra = 0.02 |
| 5* | 38.1 | 7.9 | 0.28 | 0.38 | 0.801 | 0.001 | 0.6 | Rz = 0.5 Ra = 0.10 |
| 6 | 38.6 | 13.2 | 0.18 | 0.45 | 0.003 | 0.028 | 0.6 | Rz = 1.9 Ra = 0.44 |
| 7* | 39.2 | 10.6 | 0.26 | 0.27 | 0.002 | 0.635 | 0.6 | Rz = 2.5 Ra = 0.57 |

*Invention Plates

TABLE 3

| No. | Ni | Mo | Cu | Si | Mn | Al | Ti | Thickness (mm) | Surface Roughness (μm) |
|---|---|---|---|---|---|---|---|---|---|
| 1 | 75.1 | 2.8 | 3.1 | 0.13 | 0.15 | 0.001 | 0.001 | 0.5 | Rz = 2.8 Ra = 0.60 |
| 2* | 78.3 | 4.3 | 1.5 | 0.21 | 0.23 | 0.122 | 0.001 | 0.5 | Rz = 0.4 Ra = 0.08 |
| 3 | 79.8 | 3.1 | 2.8 | 0.15 | 0.18 | 0.083 | 0.132 | 0.5 | Rz = 0.1 Ra = 0.02 |
| 4* | 81.3 | 5.2 | 0.1 | 0.26 | 0.31 | 0.064 | 0.025 | 0.5 | Rz = 1.7 Ra = 0.43 |
| 5* | 82.0 | 4.8 | 0.1 | 0.20 | 0.21 | 0.966 | 0.005 | 0.5 | Rz = 0.5 Ra = 0.11 |
| 6* | 82.3 | 3.7 | 0.1 | 0.11 | 0.17 | 0.043 | 0.083 | 0.5 | Rz = 2.6 Ra = 0.52 |
| 7 | 83.5 | 4.2 | 0.1 | 0.18 | 0.15 | 0.821 | 0.548 | 0.5 | Rz = 0.1 Ra = 0.02 |

*Invention Plates

TABLE 4

| No. | Occurrence of Adhesion | Evaluation |
|---|---|---|
| 1 | 47.5 | X |
| 2* | 0.16 | ○ |
| 3 | 30.5 | X |
| 4* | 0.22 | ○ |
| 5* | 0.14 | ○ |
| 6* | 0.20 | ○ |
| 7 | 25.1 | X |
| No. 1 with alumina powder | 0.24 | ○ |

*Invention plates

TABLE 8

| No. | Occurrence of Adhesion | Evaluation |
|---|---|---|
| 1 | 46.4 | X |
| 2* | 0.22 | ○ |
| 3 | 44.3 | X |
| 4 | 26.5 | X |
| 5* | 0.24 | ○ |
| 6 | 31.2 | X |
| 7* | 0.18 | ○ |
| No. 2 with alumina powder | 0.26 | ○ |

*Invention plates

TABLE 5

| No. | Ni | Cr | Si | Mn | Al | Ti | Thickness (mm) | Surface Roughness (μm) |
|---|---|---|---|---|---|---|---|---|
| 1* | 41.3 | 4.2 | 0.23 | 0.30 | 0.083 | 0.065 | 0.3 | Rz = 2.9 Ra = 0.55 |
| 2 | 43.5 | 2.8 | 0.19 | 0.26 | 0.065 | 0.023 | 0.3 | Rz = 0.1 Ra = 0.02 |
| 3 | 45.1 | 3.0 | 0.11 | 0.38 | 0.005 | 0.003 | 0.3 | Rz = 1.7 Ra = 0.41 |
| 4* | 46.4 | 4.3 | 0.31 | 0.15 | 0.544 | 0.032 | 0.3 | Rz = 1.6 Ra = 0.36 |
| 5 | 48.7 | 1.4 | 0.16 | 0.22 | 0.003 | 0.001 | 0.3 | Rz = 3.1 Ra = 0.73 |
| 6* | 49.2 | 0.8 | 0.21 | 0.18 | 0.006 | 0.716 | 0.3 | Rz = 1.6 Ra = 0.31 |
| 7* | 51.1 | 1.8 | 0.28 | 0.41 | 0.867 | 0.003 | 0.3 | Rz = 0.7 Ra = 0.15 |

*Invention Plates

TABLE 9

| No. | Ni | Cr | Si | Mn | Al | B | Thickness (mm) | Surface Roughness (μm) |
|---|---|---|---|---|---|---|---|---|
| 1* | 39.5 | 8.3 | 0.31 | 0.29 | 0.113 | 0.0062 | 0.5 | Rz = 1.2 Ra = 0.26 |

TABLE 9-continued

| No. | Ni | Cr | Si | Mn | Al | B | Thickness (mm) | Surface Roughness (μm) |
|---|---|---|---|---|---|---|---|---|
| 2 | 46.2 | tr | 0.19 | 0.41 | 0.074 | 0.0004 | 0.5 | Rz = 0.2 Ra = 0.03 |
| 3* | 46.8 | 1.3 | 0.25 | 0.48 | 0.328 | 0.0156 | 0.5 | Rz = 2.4 Ra = 0.56 |
| 4 | 47.5 | 4.5 | 0.16 | 0.34 | 0.001 | 0.0006 | 0.5 | Rz = 3.2 Ra = 0.65 |
| 5* | 48.8 | tr | 0.26 | 0.29 | 0.066 | 0.0087 | 0.5 | Rz = 2.1 Ra = 0.51 |
| 6 | 50.4 | tr | 0.22 | 0.25 | 0.022 | 0.0004 | 0.5 | Rz = 1.5 Ra = 0.34 |

*Invention Plates

TABLE 10

| No. | Occurrence of adhesion | Evaluation |
|---|---|---|
| 1* | 0.18 | ○ |
| 2 | 27.1 | X |
| 3* | 0.16 | ○ |
| 4 | 47.1 | X |
| 5* | 0.20 | ○ |
| 6 | 40.7 | X |
| No. 2 with alumina powder | 0.20 | ○ |

*Invention plates

TABLE 11

| No. | Depth of Edge Cracks | Yield in Hot rolling | Occurrence of Adhesion | Evaluation |
|---|---|---|---|---|
| 1* | 0 | 100 | 0.18 | ○ |
| 2 | 13 | 83 | 27.1 | X |
| 3* | 0 | 100 | 0.16 | ○ |
| 4 | 4 | 92 | 47.1 | X |
| 5* | 0 | 100 | 0.20 | ○ |
| 6 | 10 | 88 | 40.7 | X |

*Invention Plates
Depth of edge cracks = Average depth of edge cracks on one side of a 200 mm thick hot rolled plates
Yield in hot rolling = Yield after edge crack portion has been removed

What is claimed is:

1. A plate material of an alloy consisting of in weight percent 35–60% Ni and the balance Fe and unavoidable incidental impurities and containing 0.04–1.2% of one or more of Al and Ti, said plate having a surface roughness of Rz≧0.5 μm or Ra≧0.06 μm.

2. A plate material of an alloy consisting of in weight percent 60–85% Ni, ≦6% Mo, ≦4% Cu and the balance Fe and unavoidable incidental impurities and containing 0.04–1.2% of one or more of Al and Ti, said plate having a surface roughness of Rz≧0.5 μm or Ra≧0.06 μm.

3. A plate material of an alloy consisting of in weight percent 40–52% Ni, 0.5–5% Cr and the balance Fe and unavoidable incidental impurities and containing 0.04–1.2% of one or more of Al and Ti, said plate having a surface roughness of Rz≧0.5 μm or Ra≧0.06 μm.

4. A plate material of an alloy consisting of in weight percent 35–40% Ni, 5–14% Cr and the balance Fe and unavoidable incidental impurities and containing 0.04–1.2% of one or more of Al and Ti, said plate having a surface roughness of Rz ≧0.5 μm or Ra≧0.06% μm.

5. The plate material of claim 1, wherein the alloy further contains 0.001–0.02% B.

6. The plate material of claim 2, wherein the alloy further contains 0.001–0.02% B.

7. The plate material of claim 3, wherein the alloy further contains 0.001–0.02% B.

8. The plate material of claim 4, wherein the alloy further contains 0.001–0.02% B.

9. The plate material of claim 1, wherein the alloy contains 0.04–5% of one or more of Al and Ti.

10. The plate material of claim 2, wherein the alloy contains 0.04–0.5% of one or more of Al and Ti.

11. The plate material of claim 3, wherein the alloy contains 0.04–0.5% of one or more of Al and Ti.

12. The plate material of claim 4, wherein the alloy contains 0.04–0.5% of one or more of Al and Ti.

13. The plate material of claim 5, wherein the alloy contains 0.04–5% of one or more of Al and Ti.

14. The plate material of claim 6, wherein the alloy contains 0.04–0.5% of one or more of Al and Ti.

15. The plate material of claim 7, wherein the alloy contains 0.04–0.5% of one or more of Al and Ti.

16. The plate material of claim 8, wherein the alloy contains 0.04–0.5% of one or more of Al and Ti.

* * * * *